US010789791B2

(12) United States Patent
Naylor et al.

(10) Patent No.: US 10,789,791 B2
(45) Date of Patent: Sep. 29, 2020

(54) LOCK STATUS DETECTION

(71) Applicant: INTERNATIONAL BUSINESS MACHINES CORPORATION, Armonk, NY (US)

(72) Inventors: Alexander John Naylor, Newbury (GB); Samuel Smith, Eastleigh (GB); Oliver Masters, Birmingham (GB); Aaron Tomor Robert Gashi, Eastleigh (GB)

(73) Assignee: International Business Machines Corporation, Armonk, NY (US)

( * ) Notice: Subject to any disclaimer, the term of this patent is extended or adjusted under 35 U.S.C. 154(b) by 46 days.

(21) Appl. No.: 16/194,446

(22) Filed: Nov. 19, 2018

(65) Prior Publication Data

US 2020/0160634 A1 May 21, 2020

(51) Int. Cl.
*G07C 9/00* (2020.01)
*E05B 35/00* (2006.01)

(52) U.S. Cl.
CPC ..... *G07C 9/00309* (2013.01); *E05B 35/001* (2013.01)

(58) Field of Classification Search
CPC ..... G07C 9/00309; E05B 35/001
See application file for complete search history.

(56) References Cited

U.S. PATENT DOCUMENTS

| | | | | |
|---|---|---|---|---|
| 8,390,448 | B2 | 3/2013 | Weinstein | |
| 2009/0064746 | A1 | 3/2009 | Bigdely Shamlo | |
| 2009/0201151 | A1 | 8/2009 | De Levie et al. | |
| 2014/0120905 | A1* | 5/2014 | Kim | H04W 12/06 455/426.1 |

FOREIGN PATENT DOCUMENTS

| | | | |
|---|---|---|---|
| CN | 102607640 | B | 9/2014 |
| CN | 204343810 | U | 5/2015 |

OTHER PUBLICATIONS

Mell et al., "The NIST Definition of Cloud Computing", Recommendations of the National Institute of Standards and Technology, NIST Special Publication 800-145, Sep. 2011, 7 pages.

(Continued)

*Primary Examiner* — Ryan W Sherwin
(74) *Attorney, Agent, or Firm* — Ewa M. Wozniak

(57) ABSTRACT

A method, computer system, and computer program product for using strain gauges to detect a state of a lock. The strain gauges may be disposed within a key or a key head subsystem. The key bank system may include receiving a first signal, comparing the first signal with first or second signatures, and determining state change of a lock when the first signal matches the first or second signal within a first or second threshold. The key bank system may include receiving a current state of the lock, where the state of the lock is the first state, and changing the current state of the lock to a second state, where the second state is opposite the first state. The current state of the lock may be displayed on a communication device and may be stored in a memory of a communication device or a memory of a server.

28 Claims, 11 Drawing Sheets

(56) References Cited

OTHER PUBLICATIONS

Delaney, "The Best Smart Locks of 2018", PCMag UK, Guide, Aug. 16, 2018, pp. 1-8, http://uk.pcmag.com/surveillance-cameras/77460/guide/the-best-smart-locks-of-2017.
Saleh, "KPHOB | Did I Lock The Door? There is a Gadget For That!", Kickstarter, printed Sep. 5, 2018, pp. 1-15, https://www.kickstarter.com/projects/1634324894/kphob-did-i-lock-the-door-there-is-a-gadget-for-th.
Lavars, "August's new smart locks know when your door is left ajar", Sep. 19, 2017, pp. 1-27, https://newatlas.com/august-smart-locks-door-ajar/51400/.

* cited by examiner

Key Database 114

| Key Head Sub-system 130 OR Key 110 | Gauge Activity 132 | | State of Lock 134 | Time of Use 136 | Location (Optional) 138 |
|---|---|---|---|---|---|
| | First State 140 | Second State 142 | | | |
| A | Yes | | Locked | 8 am | |
| B | | Yes | Unlocked | 4 pm | |
| C | Yes | | Unlocked | | Office |

FIGURE 5

LOCK STATUS DETECTION

FIELD

Embodiments of the present invention relate generally to a method, system and computer program for using strain gauges to detect a state of a lock.

BACKGROUND

There are many locks which require a user to use a key to lock the lock. Some examples may include apartment locks or office locks. These locks do not lock automatically. The user may have to manually lock such a lock by using a key. Sometimes, the user may wish to know the state of a lock without being in close proximity to the lock.

BRIEF SUMMARY

An embodiment of the present invention may include a method, computer system, and computer program product for using strain gauges to detect a state of a lock. The strain gauges may be disposed within a key or within a key head sub-system. The key bank system may include receiving a first signal, comparing the first signal with a first or second signatures, and determining a state change of a lock when the first signal matches the first or second signal within a first or second threshold. The key bank system may include receiving a current state of the lock, where the state of the lock is the first state, and changing the current state of the lock to a second state, where the second state is opposite the first state. The current state of the lock may be displayed on a communication device and may be stored in a memory of a communication device or in a memory of a server. The key bank system may include receiving a location of the first key, comparing the location of the first key with a location of the lock, and determining a state change of the lock when the location of the first key matches the location of the lock within a location threshold.

BRIEF DESCRIPTION OF THE SEVERAL VIEWS OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. The drawings are discussed forthwith below.

FIG. 5 is a schematic block diagram illustrating a database for storing lock information in accordance with an embodiment of the invention.

DETAILED DESCRIPTION

Figure 1:
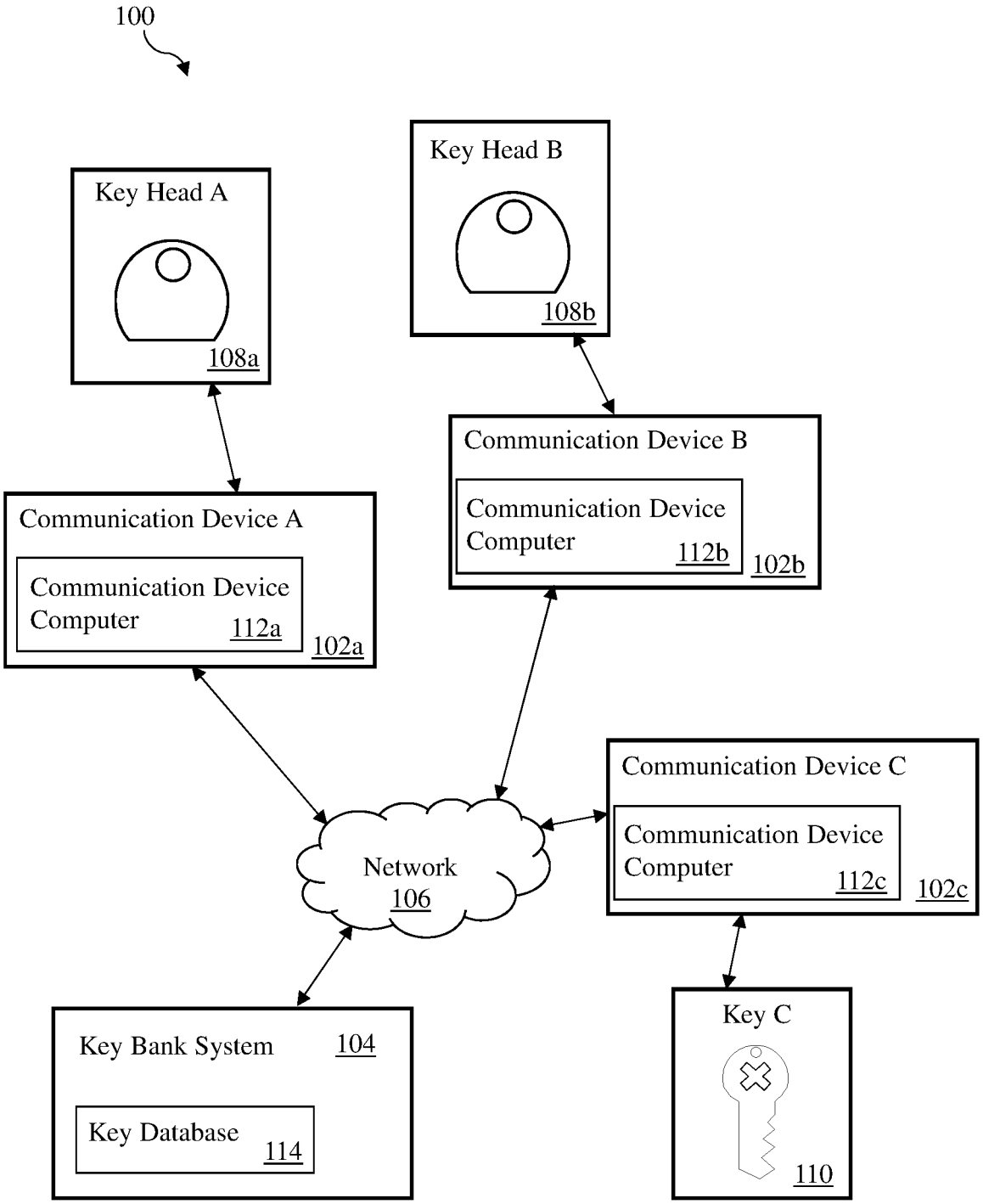
FIG. 1 is a schematic block diagram illustrating a system for using strain gauges to detect a state of a lock, in accordance with an embodiment of the invention.

Embodiments of the present invention will now be described in detail with reference to the accompanying Figures.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces unless the context clearly dictates otherwise.

Embodiments of the present invention provide a method, computer program, and computer system for using strain gauges to detect a state of a lock. The lock may be a door lock, a safe lock, a file cabinet lock, or any other lock supporting the functionality required by one or more embodiments of the invention. In an embodiment of the present invention, a user may use a key, with strain gauges embedded in its head, to change a state (locked or unlocked) of a lock and store the state change with a key bank system. Alternatively, the user may place a key head, fitted with the strain gauges, onto an existing key and use that key head and key to change the state of the lock and store the state change with the key bank system. Since the strain gauges may be placed in a key head that may then be coupled to an existing key, an advantage of the embodiment disclosed herein is that modifications to the existing lock may not be required.

Many times, a user may forget whether the user has locked a lock or not. For example, the user may forget whether the user has locked the house door lock. Further, the user may already be on his or her way to work. This may result in worry on the part of the user, who may want to travel back to the house to ensure that the house door is properly locked. Oftentimes, the user may travel back home to then realize that the house door was locked after all and the worry and effort of traveling back was unnecessary.

Embodiments of the present invention may allow the user to remotely check the status of a lock. For example, the user, while traveling to work, may realize that he or she may have forgotten to lock the house door lock. The user may access a key bank system which may allow the user to view the last known status of the house door lock. Therefore, the user may be able to determine whether the user locked the door or not. This in turn may save the user the unnecessary travel back to the house as well as the stress and aggravation associated with the uncertainty of the status of the lock.

Embodiments of the present invention may also be useful in situations where there are multiple keys that may be used for the same lock, such as multiple users living together in the same house and each having a front door key. Embodiments of the present invention may allow each user to access the key bank system to find out the state of the front door lock. Further, if one user may leave the house and forget to lock the door, then any of the remaining users may be able to lock the door with their respective keys and update the state of the lock for all users. This may allow the user, who initially may have forgotten to lock the door, to get information pertaining to which user locked the door last.

Accordingly, at least some of the embodiments described herein provide a technical solution to the problems described above with respect to detecting the status of a lock.

Specifically, some embodiments described herein provide a method of detecting the status of a lock using strain gauges embedded in a key or key head.

Reference will now be made in detail to the embodiments of the present invention, examples of which are illustrated in the accompanying drawings, wherein like reference numerals refer to like elements throughout. Embodiments of the invention are generally directed to using strain gauges to detect status of a lock.

FIG. 1 illustrates a system 100 for using strain gauges to detect a state of a lock, in accordance with an embodiment of the present invention. In an example embodiment, the system 100 may include a plurality of communication devices 102*a*, 102*b*, 102*c* and a key bank system 104, all connected via one or more networks 106. Communication devices 102*a*, 102*b*, 102*c* each comprise communication device computer 112*a*, 112*b*, 112*c*, respectively. The system 100 may also include a plurality of key heads 108*a*, 108*b* and a key 110. Each key head 108*a*, 108*b*, or key 110 may be connected to its respective communication device 102 via a wireless connection, e.g. via a Bluetooth® connection. For example, communication device 102*a* may be connected to key head 108*a*, communication device 102*b* may be connected to key head 108*b*, and communication device 102*c* may be connected to key 110.

Although FIG. 1 shows three communication devices 102*a*, 102*b*, 102*c*, two key heads, key head A 108*a* and key head B 108*b*, and one key C 110, principles of an embodiment of the present invention are not restricted to this combination. Embodiments of the present invention may use different combinations of key heads and keys 108, and communication devices 102. For example, an embodiment of the present invention may include a communication device 102*c* and a key 110, or a communication device 102*a* and a key head 108*a*. Another embodiment of the present invention may include multiple of communication devices 102, such as 102*a* and 102*b*, a key head 108*a*, and a key 110.

In the example embodiment, the network 106 is the Internet, representing a world wide collection of networks and gateways to support communications between devices connected to the Internet. The network 106 may include, for example, wired, wireless, or fiber optic connections. In alternative embodiments, the network 106 may be implemented as an intranet, a local area network (LAN), or a wide area network (WAN). In general, the network 106 can be any combination of connections and protocols that will support communications between the communication devices 102 and the key bank system 104.

In an embodiment of the present invention, the communication devices 102 may be a mobile terminal, such as a smartphone, but is not limited to such. Other examples may include user's laptop computer, tablet, or a peripheral device such as a smartwatch or other wearable device, or any programmable electronic device supporting the functionality required by one or more embodiments of the invention. The communication device may be installed in close proximity to a lock and may have Bluetooth® and Wi-Fi capability. The communication device computers 112 and the key bank system 104 may be instances of the computer 1010 shown in FIG. 9. The key bank system 104 may include a key database 114, which is described in more detail with reference to FIG. 5.

Figure 2:
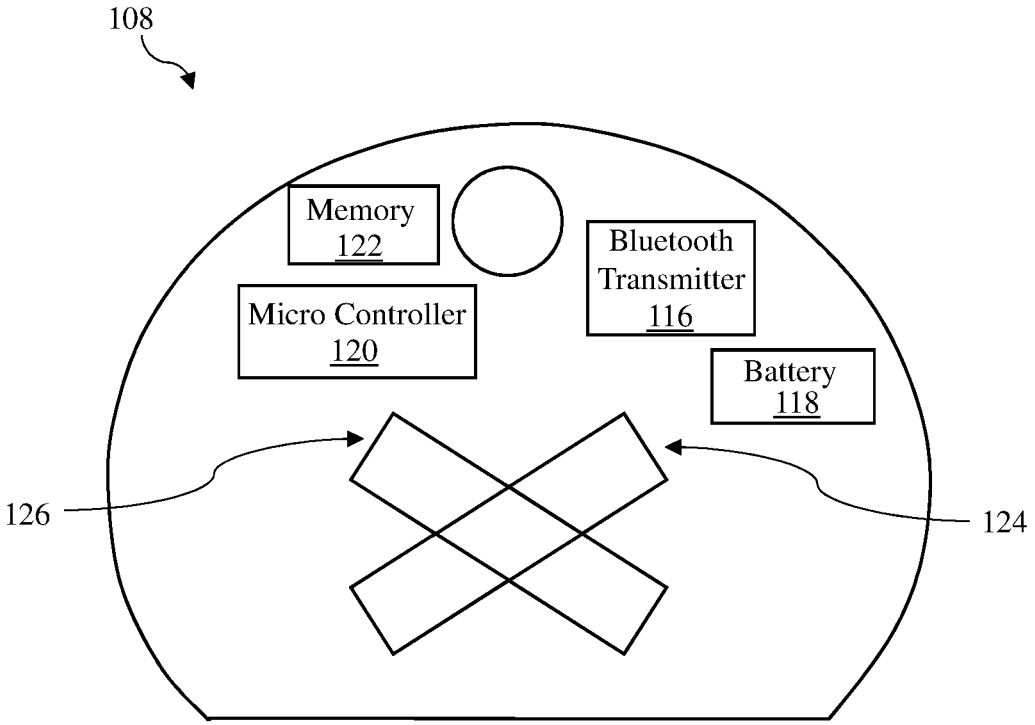
FIG. 2 is a schematic diagram illustrating a key head, in accordance with an embodiment of the present invention.

FIG. 2 illustrates an example of the key head 108. The key head 108 may be any size and shape and may be configured to fit over the top portion of any key. The key head 108 may include, in various embodiments, one or more of the following: a Bluetooth® transmitter 116, a battery 118, a micro controller 120, a memory 122, strain gauge I 124, and strain gauge II 126. The Bluetooth® transmitter 116 may be used to pair the key head 108 with the communication device 102. The battery 118 may be used to provide power to the Bluetooth® transmitter 116, the micro controller 120, the memory 122, strain gauge I 124, and strain gauge II 126.

In an embodiment of the present invention, strain gauge I 124 and strain gauge II 126 may be integrally disposed within the key head 108. Strain gauge I 124 and strain gauge II 126 may be positioned substantially orthogonally with respect to each other. Strain gauges 124 and 126 may be disposed within the key head 108 such that when the key head 108 is coupled with any key, strain gauges 124 and 126 are disposed on the axis of rotation of the key. In other embodiments, strain gauges 124, 126 may be disposed at any location and at any orientation with respect to one another that permits detection of a state change of a lock.

Strain gauge I 124 and strain gauge II 126 may be used to determine state changes of a lock. To turn a key head 108 coupled with a key, a user may exert torque force. During the turning of a key coupled with the key head 108 to a first state, strain gauge I 124 may experience tension whereas strain gauge II 126 may experience compression. During the turning of a key coupled with the key head 108 to a second state, where the second state is opposite of the first state, strain gauge I 124 may experience compression whereas strain gauge II 126 may experience tension. Strain gauges 124 and 126 may convert the changes in tension and compression, as a result of the turning of the key coupled with the key head 108, to a change in electrical resistance. A torque value proportional to the change in electrical resistance may be determined using the micro controller 120.

The micro controller 120 may take the changes in electrical resistance, such as changes in the current and voltage, and translate the change into a digital value. Therefore, the micro controller 120 may take the current and voltage changes, associated with the strain gauges 124 and 126 being in a first state, and convert the changes to a digital value that may be associated with the first state. The digital value associated with the first state may be called a first signature.

The micro controller 120 may take the current and voltage changes, associated with the strain gauges 124 and 126 being in a second state, and convert the changes to a digital value that may be associated with the second state. The digital value associated with the second state may be called a second signature. Alternatively, any sensor capable of providing a torque signal to the micro controller 120 may be employed.

The micro controller 120 may also send the first signature or the second signature to the Bluetooth® transmitter 116, and may request the Bluetooth® transmitter 116 to transmit the signatures to the key database 114 for storage. The micro controller 120 may also send the digital value to memory 122. Memory 122 may store the signatures associated with strain gauges 124 and 126 being in the first and second states.

Figure 3:
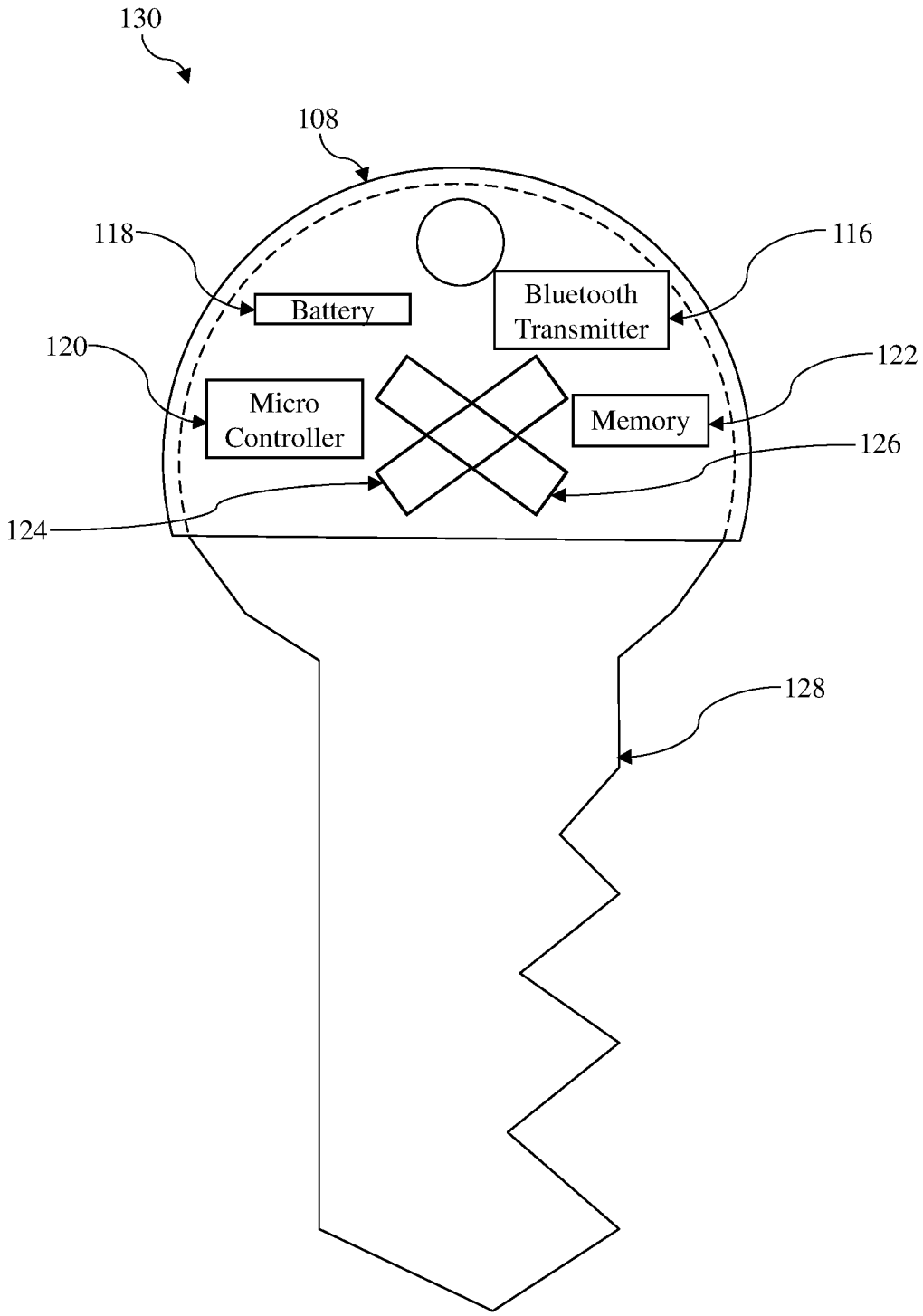
FIG. 3 is a schematic diagram illustrating a key head coupled with a key, in accordance with an embodiment of the present invention.

FIG. 3 illustrates a key head sub-system 130 which is an example embodiment of the present invention. The key head sub-system 130 may include the key head 108 coupled to a key 128. The key 128 may be a house door key, safe key, locker key, file cabinet key, or any other key supporting the functionality required by one or more embodiments of the invention. The key head 108 may include the components described herein with reference to FIG. 2. The key head 108 with strain gauge I 124 and strain gauge II 126 may be positioned over the key 128 such that the strain gauges 124 and 126 may be on the axis of rotation of the key 128.

Alternative embodiments of the present invention, not shown in the Figures, may include two sets of strain gauges. Each set of strain gauges may include strain gauge I 124 and strain gauge II 126. One set of strain gauges may be integrally disposed within one side of the key head 108 and the other set of strain gauges may be integrally disposed within the opposite side of the key head 108.

Figure 4:
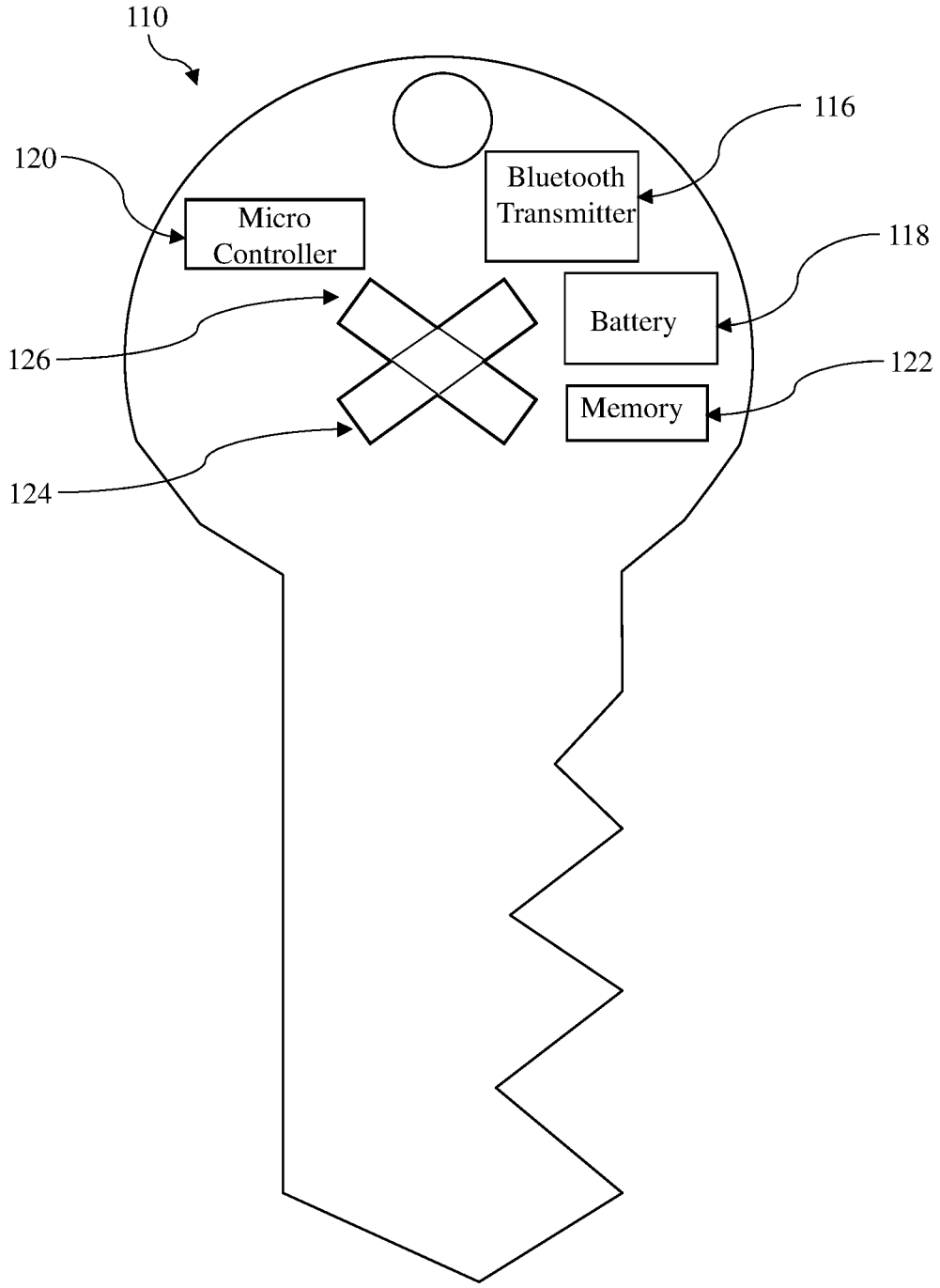
FIG. 4 is a schematic diagram illustrating a key with strain gauges, in accordance with an embodiment of the present invention.

Referring to FIG. 4, a schematic diagram of an alternative embodiment of the present invention is shown. As described herein with respect to FIG. 1, the method 100 may include key C 110 communicating with the communication device C 102*c*. The key C 110 of FIG. 1 is shown in greater detail in FIG. 4. In an alternative embodiment of the present invention, the Bluetooth® transmitter 116, the battery 118, the micro controller 120, the memory 122, strain gauge I 124, and strain gauge II 126 may be located on the top portion of the key 110 itself. Just as with the key head 108, strain gauge I 124 and strain gauge II 126 may be integrally disposed within the key 110 on the axis of rotation of the key 110. Further, the Bluetooth® transmitter 116, the battery 118, the micro controller 120, the memory 122, strain gauge I 124, and strain gauge II 126 may operate in the same manner as described herein with reference to FIG. 2.

FIG. 5 illustrates, in schematic view, different categories of information that may be stored in the key database 114. As shown in FIG. 1, the key database 114 may be located in the key bank system 104. The key database 114 may be a centralized database and may have a remote location. For example the key database 114 may be located on a server. In an alternative embodiment the key database 114 may also be stored in a memory of the communication device 102. The key database 114 may allow a user to obtain a state of a lock without being in close proximity to the lock. For example, the user may obtain a state of a lock, associated with the user's apartment door, when the user is located in another city, state, or country.

The key database 114 may be associated with one or more locks and may indicate the key head sub-systems 130 or the keys 110 associated with the one or more locks. For example, the key database 114 may be associated with one lock, such as an apartment door lock, and may have a number of key head sub-systems 130 only, keys 110 only, or a combination of both key head sub-systems 130 and keys 110, associated with that one lock. For example, three users may have access to an apartment, each with its own key head sub-system 130 or key 110, such as a first key, a second key and a third key. Each user may be able to access the key database 114 to obtain the state of the apartment door lock. Further, the key database 114 may be updated after each user's use of the user's key 110 or the key head sub-system 130. For example, if the first user, user A, was the last to leave the apartment and change the status of the lock using the user's key head sub-system A 130 or the key A 110, the key database 114 may display that the last change to the state of the lock occurred with the key head sub-system A 130 or the key A 110. Further, the key database 114 may display the actual state of the lock 134 as well. Any of the three users may access the key database 114 to obtain the updated information.

The key database 114 may also be associated with a plurality of locks, such as a front door lock and a back door lock and may have a different number of combinations of key head sub-systems 130 and/or keys 110 associated with the plurality of locks.

The key database 114 may be used to store identifying information respecting the key head sub-system 130 or the key 110, such as which key head sub-system 130 or key 110 was used to change a state of a lock 134. The key database 114 may also store gauge activity 132. More particularly, the gauge activity 132 may refer to the strain gauges 124 and 126 being in a first state 140 or a second state 142. The first state may be associated with strain gauges 124 and 126 generating a change in electrical resistance which may translate to the digital value that corresponds to the first signature. The first signature may be associated with the locking of the lock. The second state may be associated with strain gauges 124 and 126 generating a change in electrical resistance which may translate to the digital value that corresponds to the second signature. The second signature may be associated with the unlocking of the lock.

Embodiments of the present invention may be more apparent in the following examples. Referring to FIG. 5, line 1, the key database 114 may indicate that key head sub-system A 130, or key A 110 may be used to change the state of the lock 134. More particularly, the gauge activity 132 may register that the strain gauges 124 and 126 of the key head sub-system A 130 or key A 110 may be in the first state 140. Since the first state 140 may be associated with the locking of the lock, the state of the lock 134 may show that the lock is locked. In another example, as illustrated in line 2 of FIG. 5, the key database 114 may indicate that the key head sub-system B 130, or key B 110 may be used to change the state of the lock 134. The gauge activity 132 on key head sub-system B 130 or key B 110 may indicate that the strain gauges 124 and 126 may be in the second state 142. Therefore, the state of the lock 134 may show that the lock is unlocked.

The key database 114 may also store information pertaining to an optional location 138 of the key head sub-system 130 or the key 110. The location 138 may be based on the GPS location of the communication device 102 with which the key head sub-system 130 or the key 110 is connected with via Bluetooth®. In an embodiment of the present invention, the location 138 may indicate where the key head sub-system 130 or the key 110 is physical located at the time the gauge activity 132 indicates that the key head sub-system 130 or the key 110 is in use. For example, if the GPS location of the communication device 102 indicates that the communication device 102 is in the office, then the key head sub-system 130 or the key 110 connected to the communication device 102 may also be located in the office.

Alternatively, the location 138 may be based on a Wi-Fi signal strength of the communication device 102 with which the key head sub-system 130 or the key 110 is connected with via Bluetooth®. The use of a Wi-Fi signal strength to determine the location 138 of the key head sub-system 130 or the key 110 may be helpful when the when one key head sub-system 130 or one key 110 may be used to lock or unlock multiple locks, such as a front door lock and a back door lock. Often, the Wi-Fi signal strength may be stronger at one location as opposed to the other. For example, the Wi-Fi signal may be stronger at the front door lock when compared to the back door lock. Therefore, the Wi-Fi signal strength may be used to establish the location 138 of the key head sub-system 130 or the key 110 to determine which lock had its state changed. Alternative embodiments of the present invention may use any technology capable of accurately determining the position of the user's communication device 102.

The optional method for determining location 138 may have a location threshold that may be set by the user of the key database 114. The location threshold may be a set distance from the physical location of the lock, e.g. about 5 feet of the lock or any other suitable distance. Therefore, if the user is within that location threshold, the key database 114 may recognize that the user is within close proximity of the lock. If the user is outside of the location threshold, the key database 114 may determine that the user is not within close proximity to the lock.

The optional location 138 of the key head sub-system 130 or the key 110 may also be used to disregard signals from the gauge that do not correspond with a state change and to display accurate states of the lock 134. For example, the lock associated with key head sub-systems A, B, and C 130 or keys A, B, and C 110 may be an apartment door lock. When one of the key head sub-systems A, B, and C 130 or keys A, B, and C 110 is used to lock the apartment door, the optional location 138 may indicate that the key head sub-systems A, B, and C 130 or keys A, B, or C 110 is located at the door of the apartment. As a result, the state of the lock 134 may be updated. However, if the key database determines that there is gauge activity 132 but the location 138 indicates that the key head sub-systems A, B, and C 130 or keys A, B, or C 110 is not located at or in close proximity to the door of the apartment, the gauge activity 132 may be ignored and the state of the lock 134 may indicate the last state 134 during which the key head sub-systems A, B, and C 130 or keys A, B, or C 110 was located 138 at the door of the apartment.

For example, referring to line 3 of FIG. 5, the gauge activity 132 of the key head sub-system C 130 or key C 110 may indicate that the strain gauges 124 and 126 are in the first state 140, translating to the lock being locked. However, the location 138 of key head sub-system C 130 or key C 110 may indicate that the key head sub-system C 130 or key C 110 is located in an office location, not at or proximate the door of the apartment. Therefore, any gauge activity 132 may be labeled as a false reading and be ignored. As a result, the key database 114 may display the last known state of the lock 134. In this scenario, the last known state of the lock 134 may be the state of the lock 134 associated with gauge activity 132 of key head sub-system B 130 or key B 110. Thus, as the third line of FIG. 5 indicates, even though key head sub-system C 130 or key C 110 may indicate that the strain gauges 124 and 126 are in the first state 140, the state of lock may not be changed to locked. Rather, the state of the lock 134 may remain as unlocked, as illustrated in line 2 of FIG. 5.

The key database 114 may optionally store information pertaining to a time of use 136 of the key head sub-system 130 or the key 110. The time of use 136 of the key head sub-system 130 or the key 110 may be used to determine at what time the key head sub-system 130 or the key 110 may have been used to change the state of the lock 134. The time of use 136 may be configured to the needs and specifications of each user or to the specific requirements for each lock. For example, the time of use 136 may be configured to show the time and date the key head sub-system 130 or the key 110 may be used. Optionally, the time of use 136 may be configured to show the date only, or the time only, or any combination supported by one or more embodiments of the present invention. Further, the time of use 136 may also have different configuration for different locks. For example, the time of use 136 of one lock may indicate time only whereas the time of use 136 of another lock may indicate the date only, or both the time and date.

The optional time of use 136 may be used to indicate at what time a particular key head sub-system 130 or the key 110 was used to change the state of the lock 134. For example, referring to the first row of FIG. 5, key head sub-system A 130 or key A 110 may be associated with a door lock of an apartment (not shown in FIG. 5). The key database 114 may indicate that key head sub-system A 130 or key A 110 may be used to change the state of the lock 134 to the locked state. The key database 114 may optionally indicate that the time of use 136 of the key head sub-system A 130 or the key A 110 to change the state of the lock 134 was at 8 am, which may correspond to the time, for example when the user locked the apartment door and went to work.

In another example, as illustrated in the second row of FIG. 5, a user of key head sub-system B 130 or key B 110 may use the key head sub-system B 130 or key B 110 to change the state of the lock 134 to the unlocked state. The gauge activity 132 of the key head sub-system B 130 or key B 110 may indicate that at 4 pm, the strain gauges 124 and 126 may be in the second state 142, signifying that the lock is unlocked.

Embodiments have been described in which the key bank system 104 and the key database 114 are remote from the communication devices 102*a*, 102*b*, and 102*c*. This configuration is an advantage where two or more keys, for a single lock, are in possession of two or more users: all users may access the remote key bank system 104 to learn when any one user has locked or unlocked the single lock. However, in one embodiment, a single key may be associated with a lock. In this embodiment, the key bank system 104 and the key database 114 may be stored in a communication device or key head. This embodiment provides an advantage in that a user who does not recall whether a lock is locked may check the user's communication device for the current state of the lock.

Figure 6:
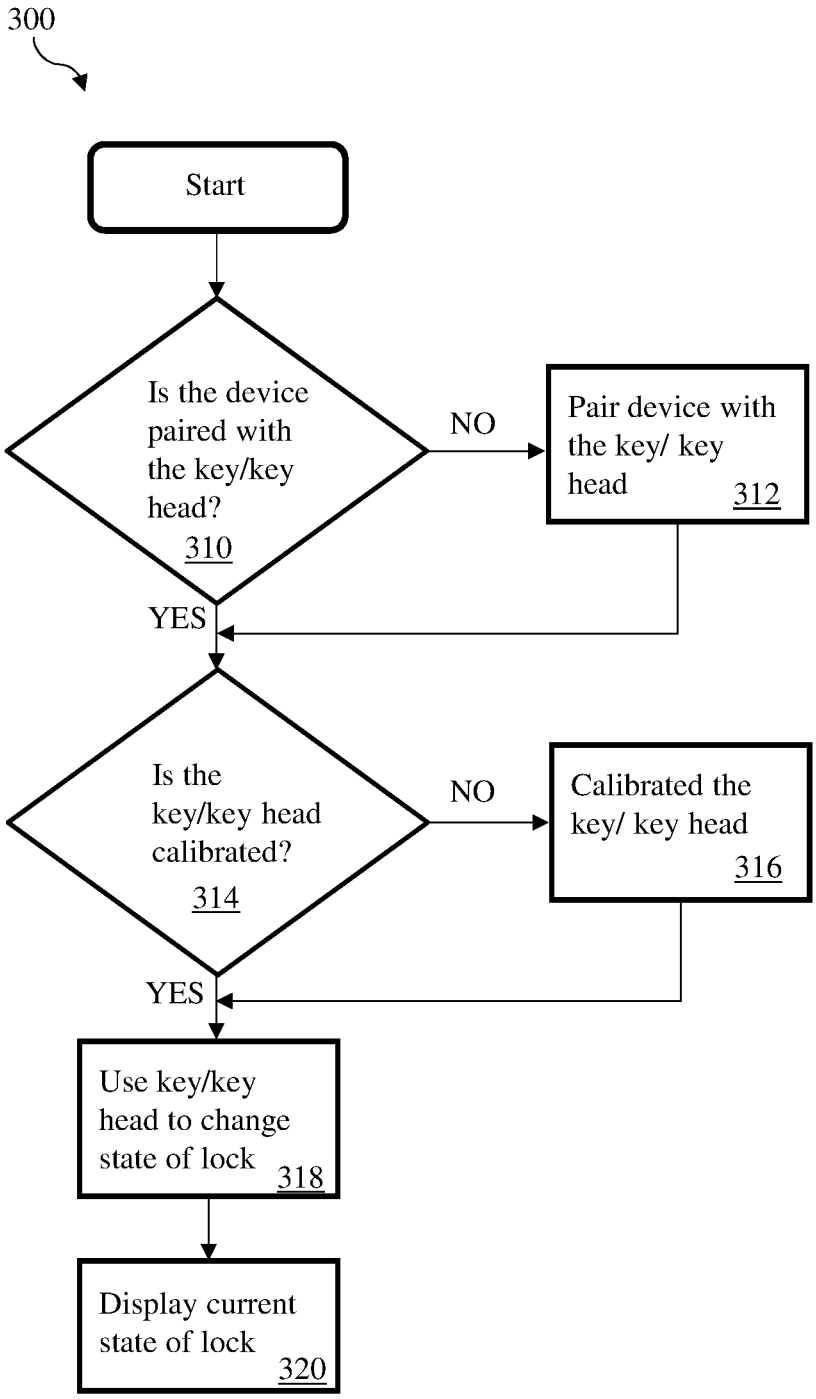
FIG. 6 is a flow chart illustrating an example method for using strain gauges to detect a state of a lock, in accordance with another embodiment of the invention.

Referring to FIG. 6, a method 300 for using the key head sub-system 130 or the key 110 to change the state of a lock 134 is depicted, in accordance with an embodiment of the present invention. Referring to operation 310, a user is asked whether the communication device 102 is paired with the key head sub-system 130 or the key 110. The pairing of the communication device 102 with the key head sub-system 130 or the key 110 allows for the communication device 102 to connect with the key head sub-system 130 or the key 110 using a Bluetooth® connection. If the communication device 102 is not paired with the key head sub-system 130 or the key 110, the user is asked, at operation 312, to conduct the pairing of the communication device 102 with the key head sub-system 130 or the key 110.

Referring to operation 314, if the communication device 102 is paired with the key head sub-system 130 or the key 110, the user is asked whether the key head sub-system 130 or the key 110 is calibrated. If the key head sub-system 130 or the key 110 is not calibrated, the user is asked, at operation 316, to calibrate the key head sub-system 130 or the key 110. The calibration of the key head sub-system 130 or the key 110 is described in more detail with reference to FIG. 7.

If the key head sub-system 130 or the key 110 is calibrated, the user may use the key head sub-system 130 or the key 110, at operation 318, to change the state of the lock 134. The user may change the state of the lock 134 by turning the key head sub-system 130 or the key 110 in the lock so as to generate a signal corresponding with the first or second signature. The first state 140 may refer to the locking of the lock and the second state 142 may refer to the unlocking of the lock. Once the state of the lock 134 is changed, the current state of the lock is displayed on the communication device 102, at operation 320. The current state of the lock may be displayed on every communication device 102 that is connected with the key database 114 and is associated with that particular lock. For example, user A and user B have access to one lock. User A may use key A 110 or key head sub-system A 130 to change the state of the lock 134 from the locked state to the unlocked state. User B, who has key B or key head sub-system B 130, may be able to obtain the change in the state of the lock 134, as a result of user A's unlocking of the lock, because the key database 114 will display the current state of the lock 134.

Figure 7:
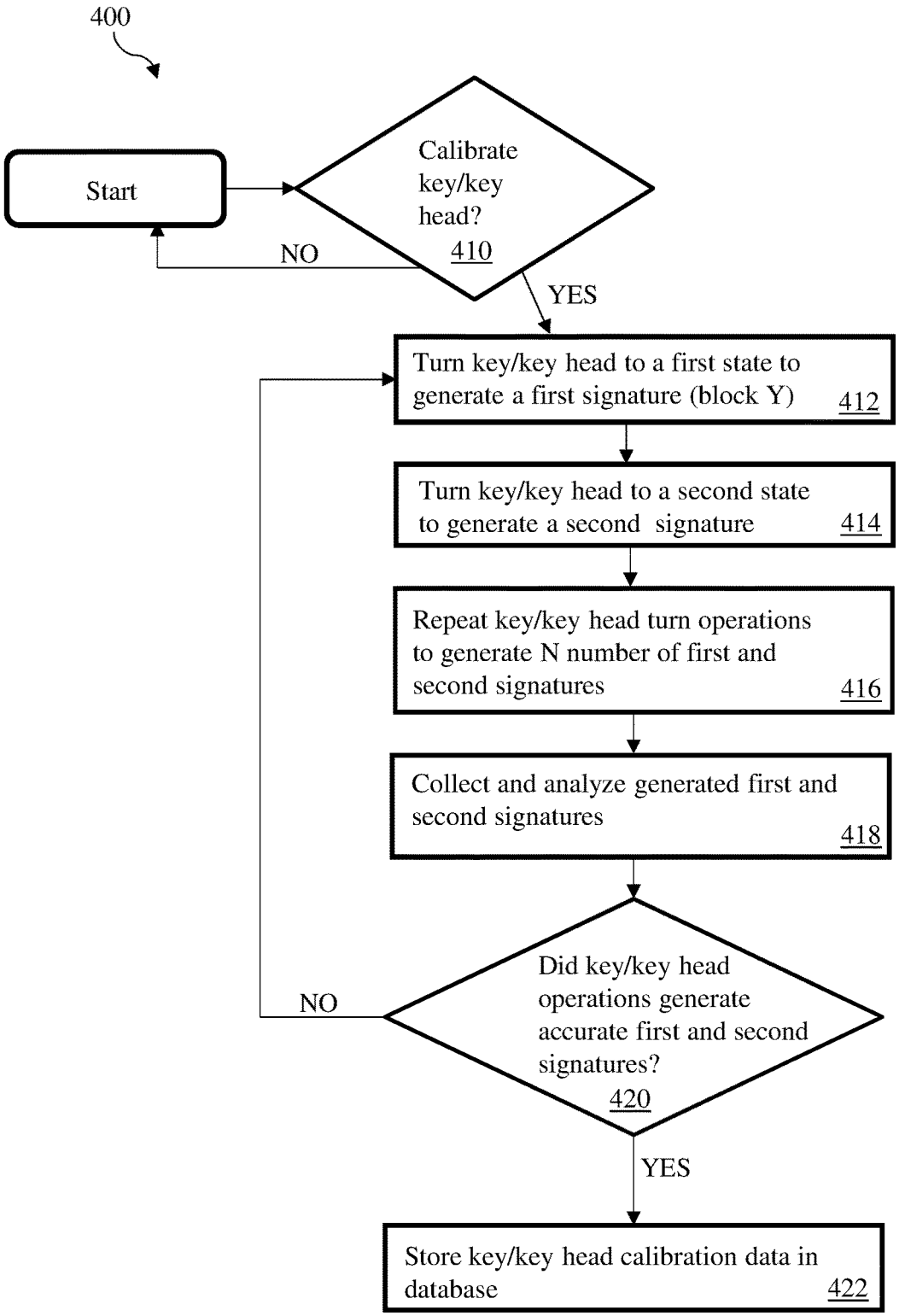
FIG. 7 is a flow chart illustrating an example method for using strain gauges to detect a state of a lock, in accordance with an embodiment of the invention.

Referring to FIG. 7, a method 400 for calibrating the key head sub-system 130 or the key 110 is depicted, in accordance with an embodiment of the present invention.

Referring to operation 410, a user is asked, by the key bank system 104, whether the user wishes to calibrate the key head sub-system 130 or the key 110. If the user does not wish to calibrate, the user is directed back to the start menu. If the user does wish to calibrate the key head sub-system 130 or the key 110, the user is moved to operation 412.

Referring to operation 412, the user is asked, by the key bank system 104, to lock the lock. With the key inserted in the lock, the user turns the key head sub-system 130 or the key 110 in a first direction to generate a first signature. During the turning of the key head sub-system 130 or the key 110 to the first state, the locked state, the strain gauge I 124 is experiencing tension whereas the strain gauge II 126 is experiencing compression, resulting in a change in the electrical current and voltage. This change in electrical resistance is translated, using a micro controller 120, to a digital value. This digital value is transmitted, using the Bluetooth® connection, to the key database 114 where it is associated with the key head sub-system 130 or the key 110 being in a first state and generating the first signature.

Referring to operation 414, the user is asked, by the key bank system 104, to unlock the lock. With the key inserted in the lock, the user turns the key head sub-system 130 or the key 110 in a second direction to generate a second signature. During the turning of the key head sub-system 130 or the key 110 to the second state, the unlocked state, the strain gauge I 124 is experiencing compression whereas the strain gauge II 126 is experiencing tension. The micro controller 120 takes the change in electrical resistance that occurs during the tension and compression of the strain gauges and translates it to a digital value. This digital value is transmitted to the key database 114 where it is associated with the key head sub-system 130 or the key 110 being in the second state and generating the second signature.

As a result of operations 412 and 414, the key database 114 receives and subsequently stores the digital values associated with the first and second signatures that strain gauge I 124 and strain gauge II 126 generate as a result of the key head sub-system 130 or the key 110 being used to either lock or unlock the lock, respectively.

Referring to operation 416, the user is asked to repeat the key head sub-system 130 or the key 110 turning operations 412 and 414 N number of times. This allows for the generation of N number of first and second signatures associated with the strain gauges 124 and 126 being in the first state and second state, respectively. Therefore, the key database 114 may have a N number of first signatures, associated with the locking of the lock, and a N number of second signatures, associated with the unlocking of the lock.

Referring to operation 418, the key bank system 104 collects, from the key database 114, the generated first and second signatures, analyzes the signatures, and determines, at operation 420, whether the key head sub-system 130 or key 110 turning operations generated a sufficient number of first and second signatures. The first and second signatures collected in operations 412-416 may vary. The signatures are analyzed using statistical methods to determine a distribution. If the turning of the key head sub-system 130 or the key 110 to the first and second states generated statistically valid distributions of the first and second signatures, then, at operation 422, the key head sub-system 130 or the key 110 calibration data is stored in the key database 114. However, if the key head sub-system 130 or the key 110 turning operations did not generate statistically valid distributions of the first and second signatures, the user is directed back to operation 412 and asked to repeat operations 412 to 420 until statistically valid distributions of the first and second signatures are obtained. The key bank system 104 may determine, based on the statistically valid distributions of the first and second signatures, a threshold level of torque force needed to put the key head sub-system 130 or the key 110 in either the first 140 or the second 142 state. Therefore, there may be a first threshold level associated with the turning of the key head sub-system 130 or the key 110 to the first state 140, and a second threshold level associated with the turning of the key head sub-system 130 or the key 110 to the second state 142.

Machine learning may be utilized to learn the required force and time, in each strain gauge reading, that is needed to turn the key head sub-system 130 or the key 110 to the first and second positions. When the user is turning the key head sub-system 130 or the key 110 to either lock or unlock the lock, the user is exerting torque force on the key head sub-system 130 or the key 110. The torque force may vary slightly each time the user is turning the key head sub-system 130 or the key 110 to lock the door, thus placing the lock in the first state 140. Likewise, the torque force may vary each time the user is turning the key head sub-system 130 or the key 110 to unlock the door, thus placing the lock in the second state 142. Machine learning may take the N number of generated first and second signatures, corresponding to the locking and unlocking of the lock respectively, and determine a threshold level of torque force needed to put the key head sub-system 130 or the key 110 in either the first 140 or the second 142 state. Therefore, there may be a first threshold level associated with the turning of the key head sub-system 130 or the key 110 to the first state 140, and a second threshold level associated with the turning of the key head sub-system 130 or the key 110 to the second state 142.

Machine learning may also be helpful in instances where the turning of the key head sub-system 130 or the key 110 may take two or more rotations. For example, the user may turn the key head sub-system 130 or the key 110 270 degrees, pause, and then turn the key head sub-system 130 or the key 110 another 270 degrees. This type of turning may produce two clear changes in electrical resistance and may be translated into a digital value that cumulatively captures the strain required to turn the key head sub-system 130 or the key 110 to the first and second states, such as locking and unlocking the lock. Further, the cumulative strain required to lock or unlock the lock may be similar every time. In addition, the first and second signatures, associated with the first and second states respectively, may have a time element.

Figure 8:
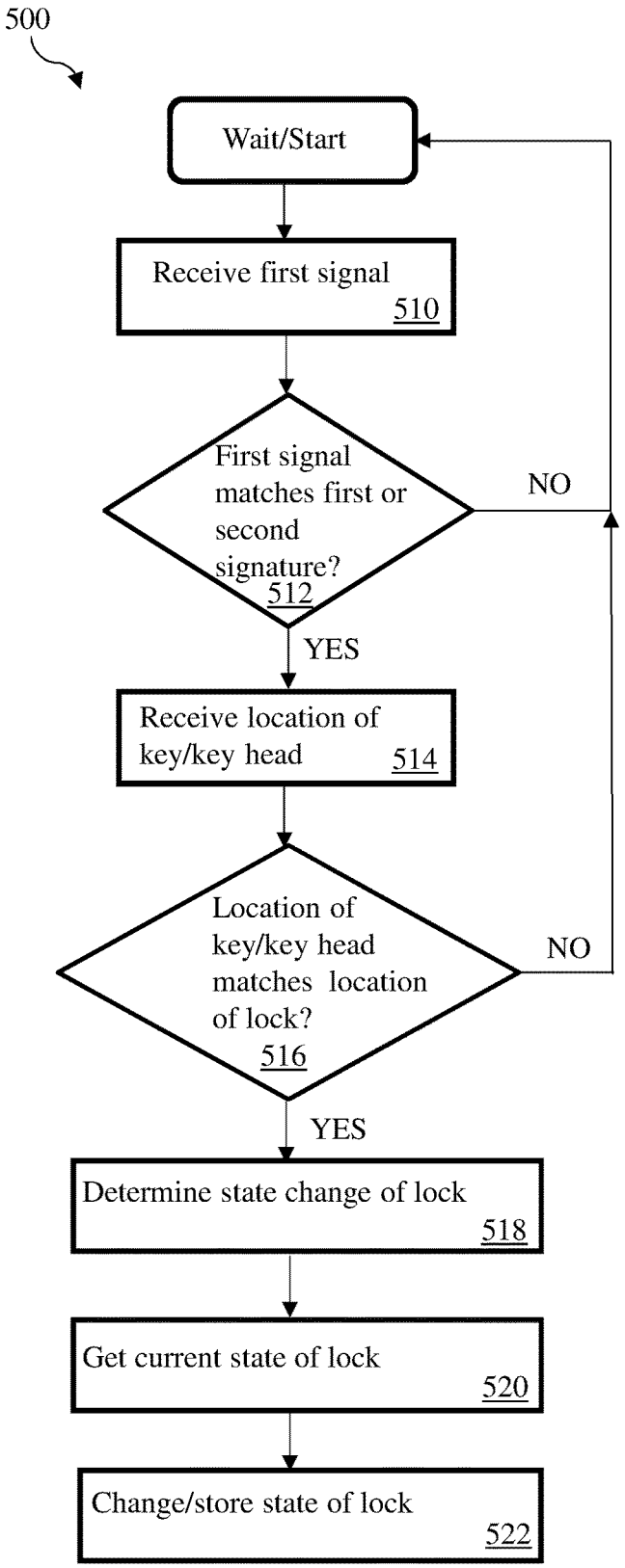
FIG. 8 is a flow chart illustrating an example method for using strain gauges to detect a state of a lock, in accordance with an embodiment of the invention.

Referring to FIG. 8, a method 500 for detecting a change in the state of a lock 134 is depicted, in accordance with an embodiment of the present invention.

Referring to operation 510, the key bank system 104 receives a first signal. The first signal may correspond to the digital value associated with the first signature or the second signature. The first signal may also correspond to an activity unrelated to the first or second signatures. For example, the first signal may be generated as a result of a user playing with the key head sub-system 130 or the key 110 thus engaging the strain gauges 124 and 126.

Once the first signal is received, the key bank system 104, at operation 512, compares the first signal with the first and second signatures that are stored in the key database 114. If the first signal matches (within a tolerance or threshold) either the first or second signatures, then the key bank system 104, moves to operation 514. If the first signal does not match either the first or the second signatures, the key bank system 104 ignores the first signal and returns to the start menu.

At operation 514, the key bank system 104 receives the location 138 of the key head sub-system 130 or the key 110 from the key database 114. As described herein with reference to FIG. 5, the location 138 may be the location of the communication device 102 to which the key head sub-system 130 or the key 110 is paired with. The location 138 of the key head sub-system 130 or the key 110 may be determined using the GPS location of the communication device 102. The location 138 may also be determined using the Wi-Fi signal strength of the communication device 102.

Referring to operation 516, the key bank system 104 determines whether the location 138 of the key head sub-system 130 or the key 110 matches the location of the lock. If the location of the lock does not match the location 138 of the key head sub-system 130 or the key 110, the key bank system ignores the first signal and returns to the start menu. If the location of the lock and the location 138 of the key head sub-system 130 or the key 110 do match, the key bank system 104 moves to operation 518 where it determines the state change of the lock. The state change of the lock may be a change from the locked to position to the unlocked position or from the unlocked position to the locked position.

Referring to operation 520, the key bank system 104 receives the current state of the lock from the key database 114. At operation 522, the key bank system 104 changes the state of the lock if it determines that the current state of the lock is opposite of the state of the lock corresponding with the first signal. If the state of the lock remains unchanged, the key bank system 104 stores the state of the lock in the key database 114. If the key bank system 104 is unsure whether the key head sub-system 130 or the key 110 has been used to either lock or unlock the lock, the key bank system 104 may prompt the user to confirm whether the user has just locked or unlocked the lock, or whether the user was simply fiddling with the key head sub-system 130 or the key 110.

In embodiments of the present invention, described above, the methods 300, 400, and 500 may be executed using the key bank system 104. Alternative embodiments of the present invention may also utilize the key head sub-system 130 to execute the operations of methods 300, 400, and 500. In an alternative embodiment, the key database 114 may also be stored in the key head sub-system 130.

Figure 9:
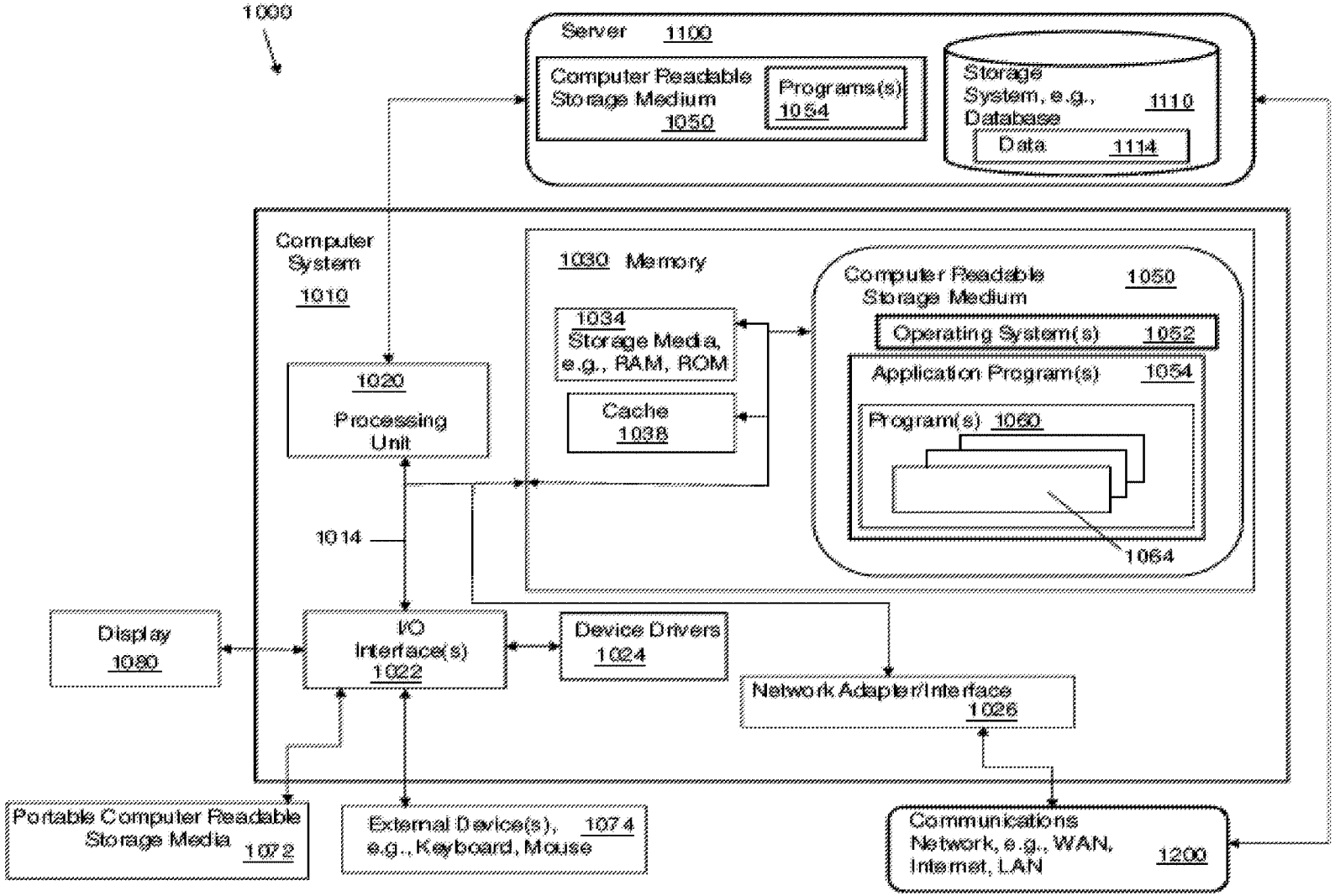
FIG. 9 is a block diagram depicting the hardware components of a system for using strain gauges to detect a state of a lock, in accordance with an embodiment of the invention.

Referring to FIG. 9, a system 1000 includes a computer system or computer 1010 shown in the form of a generic computing device. The methods 300, 400, and 500, for example, may be embodied in a program(s) 1060 (FIG. 9) embodied on a computer readable storage device, for example, generally referred to as memory 1030 and more specifically, computer readable storage medium 1050 as shown in FIG. 9. For example, memory 1030 can include storage media 1034 such as RAM (Random Access Memory) or ROM (Read Only Memory), and cache memory 1038. The program 1060 is executable by the processing unit or processor 1020 of the computer system 1010 (to execute program steps, code, or program code). Additional data storage may also be embodied as a database 1110 which can include data 1114. The computer system 1010 and the program 1060 shown in FIG. 9 are generic representations of a computer and program that may be local to a user, or provided as a remote service (for example, as a cloud based service), and may be provided in further examples, using a website accessible using the communications network 1200 (e.g., interacting with a network, the Internet, or cloud services). It is understood that the computer system 1010 also generically represents herein a computer device or a computer included in a device, such as a laptop or desktop computer, etc., or one or more servers, alone or as part of a datacenter. The computer system can include a network adapter/interface 1026, and an input/output (I/O) interface(s) 1022. The I/O interface 1022 allows for input and output of data with an external device 1074 that may be connected to the computer system. The network adapter/interface 1026 may provide communications between the computer system a network generically shown as the communications network 1200.

The computer 1010 may be described in the general context of computer system-executable instructions, such as program modules, being executed by a computer system. Generally, program modules may include routines, programs, objects, components, logic, data structures, and so on that perform particular tasks or implement particular abstract data types. The method steps and system components and techniques may be embodied in modules of the program 1060 for performing the tasks of each of the steps of the method and system. The modules are generically represented in FIG. 5 as program modules 1064. The program 1060 and program modules 1064 can execute specific steps, routines, sub-routines, instructions or code, of the program.

The method of the present disclosure can be run locally on a device such as a mobile device, or can be run a service, for instance, on the server 1100 which may be remote and can be accessed using the communications network 1200. The program or executable instructions may also be offered as a service by a provider. The computer 1010 may be practiced in a distributed cloud computing environment where tasks are performed by remote processing devices that are linked through a communications network 1200. In a distributed cloud computing environment, program modules may be located in both local and remote computer system storage media including memory storage devices.

More specifically, as shown in FIG. 9, the system 1000 includes the computer system 1010 shown in the form of a general-purpose computing device with illustrative periphery devices. The components of the computer system 1010 may include, but are not limited to, one or more processors or processing units 1020, a system memory 1030, and a bus 1014 that couples various system components including system memory 1030 to processor 1020.

The bus 1014 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

The computer 1010 can include a variety of computer readable media. Such media may be any available media that is accessible by the computer 1010 (e.g., computer system, or server), and can include both volatile and non-volatile media, as well as, removable and non-removable media. Computer memory 1030 can include additional computer readable media 1034 in the form of volatile memory, such as random access memory (RAM), and/or cache memory 1038. The computer 1010 may further include other removable/non-removable, volatile/non-volatile computer storage media, in one example, portable computer readable storage media 1072. In one embodiment, the computer readable storage medium 1050 can be provided for reading from and writing to a non-removable, non-volatile magnetic media. The computer readable storage medium 1050 can be embodied, for example, as a hard drive. Additional memory and data storage can be provided, for example, as the storage system 1110 (e.g., a database) for storing data 1114 and communicating with the processing unit 1020. The database can be stored on or be part of a server 1100. Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 1014 by one or more data media interfaces. As will be further depicted and described below, memory 1030 may include at least one program product which can include one or more program modules that are configured to carry out the functions of embodiments of the present invention.

The methods 300, 400, and 500 (FIGS. 6,7 and 8), for example, may be embodied in one or more computer programs, generically referred to as a program 1060 and can be stored in memory 1030 in the computer readable storage medium 1050. The program 1060 can include program modules 1064. The program modules 1064 can generally carry out functions and/or methodologies of embodiments of the invention as described herein. The one or more programs 1060 are stored in memory 1030 and are executable by the processing unit 1020. By way of example, the memory 1030 may store an operating system 1052, one or more application programs 1054, other program modules, and program data on the computer readable storage medium 1050. It is understood that the program 1060, and the operating system 1052 and the application program(s) 1054 stored on the computer readable storage medium 1050 are similarly executable by the processing unit 1020.

The computer 1010 may also communicate with one or more external devices 1074 such as a keyboard, a pointing device, a display 1080, etc.; one or more devices that enable a user to interact with the computer 1010; and/or any devices (e.g., network card, modem, etc.) that enables the computer 1010 to communicate with one or more other computing devices. Such communication can occur via the Input/Output (I/O) interfaces 1022. Still yet, the computer 1010 can communicate with one or more networks 1200 such as a local area network (LAN), a general wide area network (WAN), and/or a public network (e.g., the Internet) via network adapter/interface 1026. As depicted, network adapter 1026 communicates with the other components of the computer 1010 via bus 1014. It should be understood that although not shown, other hardware and/or software components could be used in conjunction with the computer 1010. Examples, include, but are not limited to: microcode, device drivers 1024, redundant processing units, external disk drive arrays, RAID systems, tape drives, and data archival storage systems, etc.

It is understood that a computer or a program running on the computer 1010 may communicate with a server, embodied as the server 1100, via one or more communications networks, embodied as the communications network 1200. The communications network 1200 may include transmission media and network links which include, for example, wireless, wired, or optical fiber, and routers, firewalls, switches, and gateway computers. The communications network may include connections, such as wire, wireless communication links, or fiber optic cables. A communications network may represent a worldwide collection of networks and gateways, such as the Internet, that use various protocols to communicate with one another, such as Lightweight Directory Access Protocol (LDAP), Transport Control Protocol/Internet Protocol (TCP/IP), Hypertext Transport Protocol (HTTP), Wireless Application Protocol (WAP), etc. A network may also include a number of different types of networks, such as, for example, an intranet, a local area network (LAN), or a wide area network (WAN).

In one example, a computer can use a network which may access a website on the Web (World Wide Web) using the Internet. In one embodiment, a computer 1010, including a mobile device, can use a communications system or network 1200 which can include the Internet, or a public switched telephone network (PSTN) for example, a cellular network. The PSTN may include telephone lines, fiber optic cables, microwave transmission links, cellular networks, and communications satellites. The Internet may facilitate numerous searching and texting techniques, for example, using a cell phone or laptop computer to send queries to search engines via text messages (SMS), Multimedia Messaging Service (MMS) (related to SMS), email, or a web browser. The search engine can retrieve search results, that is, links to websites, documents, or other downloadable data that correspond to the query, and similarly, provide the search results to the user via the device as, for example, a web page of search results.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While steps of the disclosed method and components of the disclosed system and environments have been sequentially or serially identified suing numbers and letters, such numbering or lettering is not an indication that such steps must be performed in the order recited, and is merely provided to facilitate clear referencing of the method's steps. Furthermore, steps of the method may be performed in parallel to perform their described functionality.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based email). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 10:
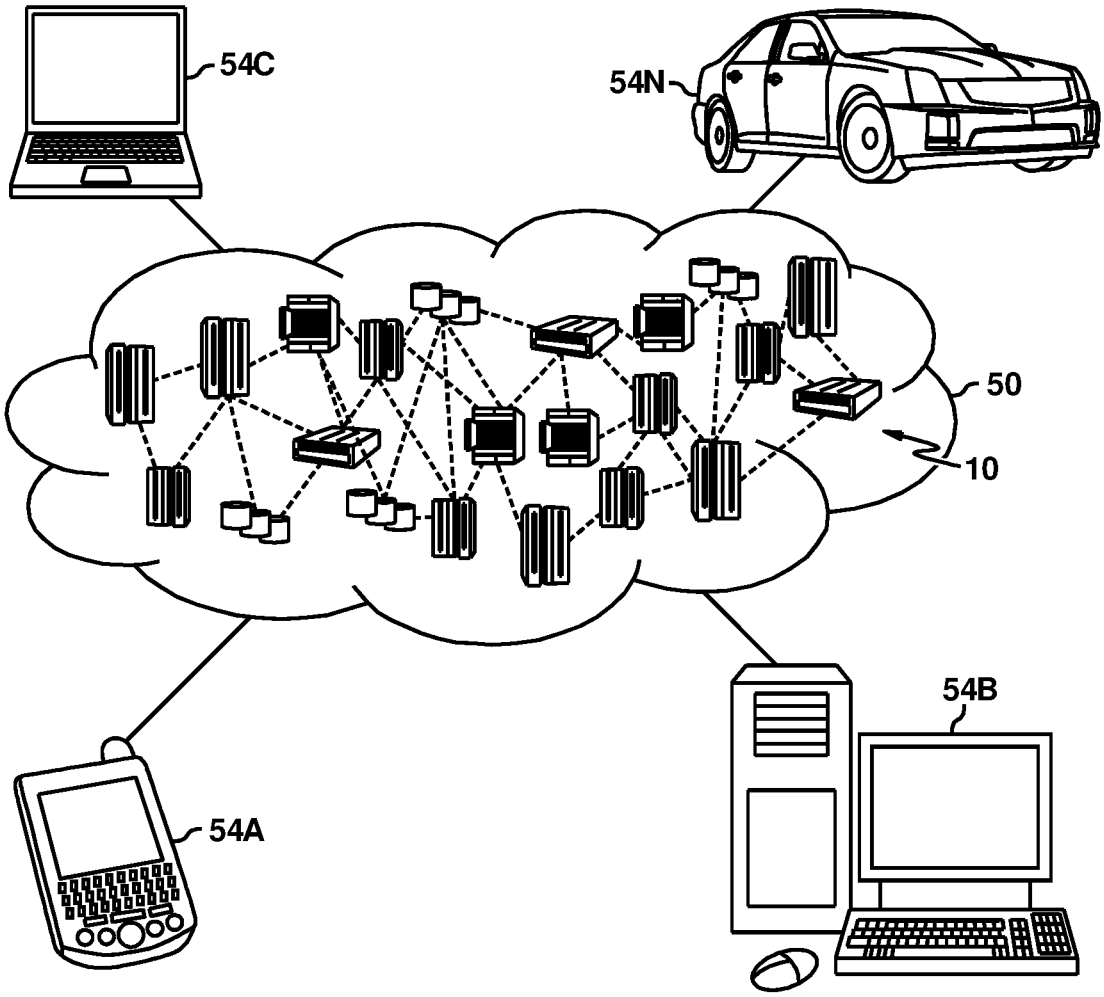
FIG. 10 is a functional block diagram depicting a cloud computing environment, in accordance with an embodiment of the invention.

Referring now to FIG. 10, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 10 are intended to be illustrative only and that computing nodes 10 and cloud computing environment 50 can communicate with any type of computerized device over any type of network and/or network addressable connection (e.g., using a web browser).

Figure 11:
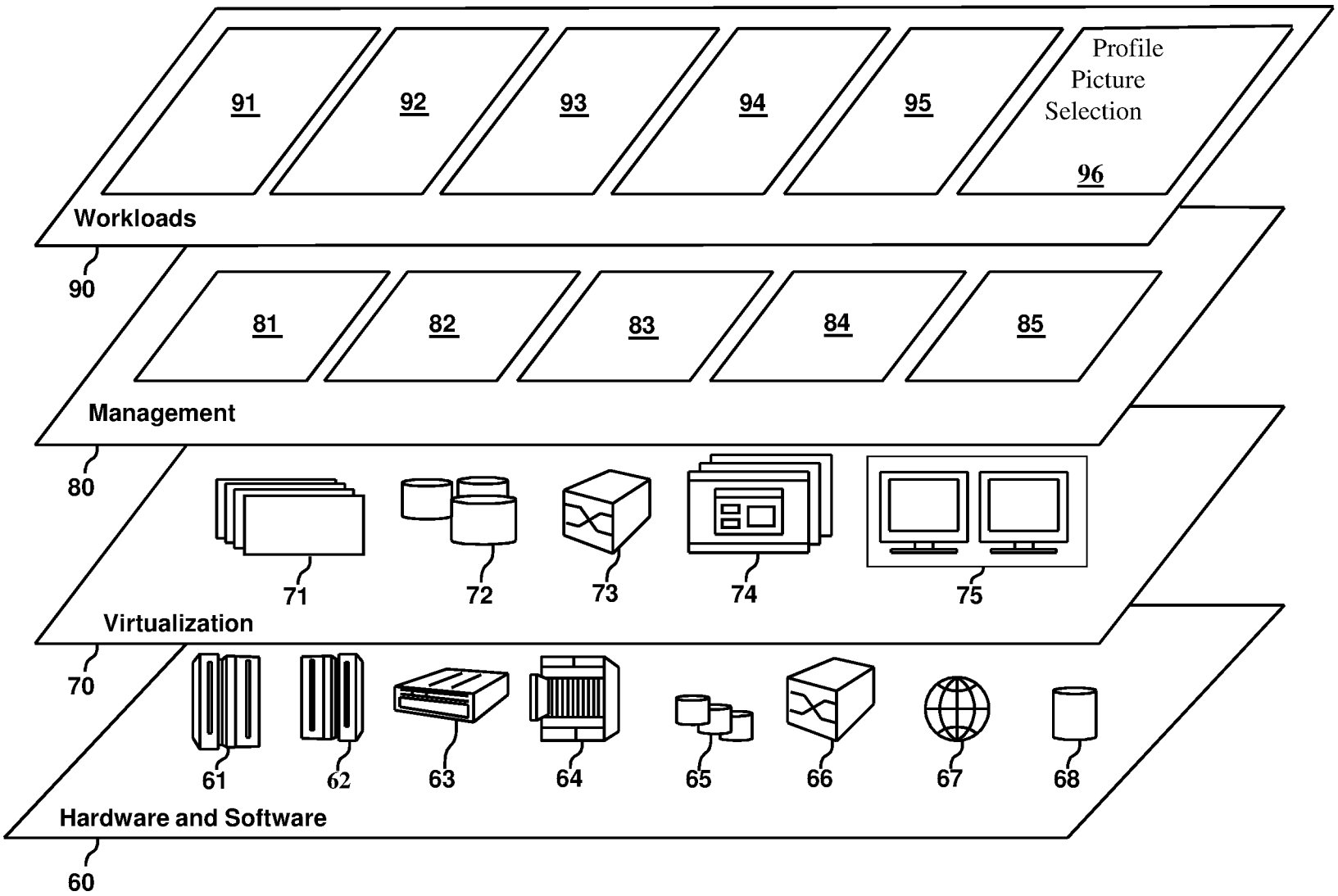
FIG. 11 is a diagram depicting abstraction model layers provided by the cloud computing environment of FIG. 10, in accordance with an embodiment of the invention.

Referring now to FIG. 11, a set of functional abstraction layers provided by cloud computing environment 50 (FIG. 10) is shown. It should be understood in advance that the components, layers, and functions shown in FIG. 11 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and determining state of a lock 96.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for using strain gauges to detect status of a lock, comprising:

receiving a first signal, wherein the first signal corresponds with a torque force experienced by two or more strain gauges;

comparing the first signal with a first signature; and determining a state change of a lock when the first signal matches the first signature within a first threshold.

2. The method of claim 1, further comprising:

comparing the first signal with a second signature; and determining a state change of a lock when the first signal matches the second signature within a second threshold.

3. The method of claim 1, further comprising:

receiving a current state of the lock, the current state of the lock being a first state; and changing the current state of the lock to a second state, the second state being opposite the first state.

4. The method of claim 3, wherein the first signal is associated with a first key, further comprising:

storing the current state of the lock in a memory of a communication device.

5. The method of claim 3, wherein the first signal is associated with a first key and a memory of a server stores the current state of the lock, further comprising:

receiving a second signal;

comparing the second signal with a second signature; and determining a state change of the lock when the second signal matches the second signature within a second threshold.

6. The method of claim 5, wherein the second signal is associated with a second key.

7. The method of claim 3, further comprising displaying, on a communication device, the state of the lock.

8. The method of claim 1, wherein the first signal is associated with a first key, further comprising:

receiving a location of the first key;

comparing the location of the first key with a location of the lock; and wherein the determining a state change of the lock includes determining a state change when the location of the first key matches the location of the lock within a location threshold.

9. The method of claim 1, wherein the two or more strain gauges are disposed within a key.

10. The method of claim 1, wherein the two or more strain gauges are disposed within a key head sub-system.

11. A system for using strain gauges to detect status of a lock, the system comprising:

a key bank system, wherein the key bank system comprises a processor, a computer readable storage medium, a key database, and program instructions stored on the computer readable storage medium being executable by the processor to cause the key bank system to:

receive a first signal, wherein the first signal corresponds with a torque force experienced by two or more strain gauges;

compare the first signal with a first signature; and determine a state change of a lock when the first signal matches the first signature within a first threshold.

12. The system of claim 11, further comprising:

comparing the first signal with a second signature; and determining a state change of a lock when the first signal matches the second signature within a second threshold.

13. The system of claim 11, further comprising:

receiving a current state of the lock, the current state of the lock being a first state; and changing the current state of the lock to a second state, the second state being opposite the first state.

14. The system of claim 13, wherein the first signal is associated with a first key, further comprising:

storing the current state of the lock in a memory of a communication device.

15. The system of claim 13, wherein the first signal is associated with a first key and a memory of a server stores the current state of the lock, further comprising:

receiving a second signal;

comparing the second signal with a second signature; and determining a state change of the lock when the second signal matches the second signature within a second threshold.

16. The system of claim 15, wherein the second signal is associated with a second key.

17. The system of claim 11, wherein the first signal is associated with a first key, further comprising:

receiving a location of the first key;

comparing the location of the first key with a location of the lock; and wherein the determining a state change of the lock includes determining a state change when the location of the first key matches the location of the lock within a location threshold.

18. The system of claim 11, wherein the two or more strain gauges are disposed within a key head sub-system.

19. A computer program product for using strain gauges to detect status of a lock, the computer program product comprising:

a computer-readable storage medium having program instructions embodied therewith, the program instructions executable by a computer to cause the computer to perform operations, comprising:

receiving a first signal, wherein the first signal corresponds with a torque force experienced by two or more strain gauges;

comparing the first signal with a first and a second signature;

determining a state change of a lock when the first signal matches the first signature or the second signature within a first or a second threshold;

receiving a current state of the lock, the current state of the lock being a first state; and changing the current state of the lock to a second state, the second state being opposite the first state.

20. The computer program product of claim 19, further comprising:

comparing the first signal with a second signature; and determining a state change of a lock when the first signal matches the second signature within a second threshold.

21. The computer program product of claim 19, further comprising:

receiving a current state of the lock, the current state of the lock being a first state; and changing the current state of the lock to a second state, the second state being opposite the first state.

22. The computer program product of claim 21, wherein the first signal is associated with a first key, further comprising:

storing the current state of the lock in a memory of a communication device.

23. The computer program product of claim 21, wherein the first signal is associated with a first key and a memory of a server stores the current state of the lock, further comprising:

receiving a second signal;

comparing the second signal with a second signature; and determining a state change of the lock when the second signal matches the second signature within a second threshold.

24. The computer program product of claim 23, wherein the second signal is associated with a second key.

25. The computer program product of claim 21, further comprising displaying, on a communication device, the state of the lock.

26. The computer program product of claim 19, wherein the first signal is associated with a first key, further comprising:

receiving a location of the first key;

comparing the location of the first key with a location of the lock; and wherein the determining a state change of the lock includes determining a state change when the location of the first key matches the location of the lock within a location threshold.

27. The computer program product of claim 19, wherein two or more strain gauges are disposed within a key.

28. The computer program product of claim 19, wherein two or more strain gauges are disposed within a key head sub-system.

* * * * *